US006503376B2

(12) United States Patent
Toyoda et al.

(10) Patent No.: US 6,503,376 B2
(45) Date of Patent: Jan. 7, 2003

(54) ELECTROPLATING APPARATUS

(75) Inventors: Yoshihiko Toyoda, Hyogo (JP); Kiyoshi Hayashi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 18 days.

(21) Appl. No.: 09/777,872

(22) Filed: Feb. 7, 2001

(65) Prior Publication Data

US 2002/0056636 A1 May 16, 2002

(30) Foreign Application Priority Data

Sep. 25, 2000 (JP) ..... 2000-289784

(51) Int. Cl.[7] ..... C25D 17/00
(52) U.S. Cl. ..... 204/252; 204/224 R
(58) Field of Search ..... 204/224 R, 252, 204/263

(56) References Cited

U.S. PATENT DOCUMENTS 3,763,027 A * 10/1973 Pearson ..... 204/224 R
4,062,755 A * 12/1977 Turner ..... 204/225
5,441,629 A 8/1995 Kosaki ..... 205/148
6,132,587 A * 10/2000 Jorne et al. ..... 204/224 R
6,251,251 B1 * 6/2001 Uzoh et al. ..... 204/224 R
6,261,426 B1 * 7/2001 Uzoh et al. ..... 204/224 R
6,332,963 B1 * 12/2001 Sakaki et al. ..... 204/224 R
6,365,017 B1 * 4/2002 Hongo et al. ..... 204/212

FOREIGN PATENT DOCUMENTS

JP 1-294888 11/1989

OTHER PUBLICATIONS

1993 Proceedings Tenth International VLSI Multilevel Interconnection Conference (VMIC), Jun. 1993, VMIC Catalog No. 93ISMIC–102.

* cited by examiner

*Primary Examiner*—Nam Nguyen
*Assistant Examiner*—Thomas H. Parsons
(74) *Attorney, Agent, or Firm*—Leydig, Voit & Mayer, Ltd.

(57) ABSTRACT

The electroplating apparatus includes a substrate disposed above an insoluble anode and a filter disposed between the insoluble anode and the substrate for removing oxygen generated at the insoluble anode. This plating apparatus using an insoluble anode allows easy placement and removal of the substrate and prevents poor deposition and poor filling caused by accumulation, on the substrate, of oxygen generated at the insoluble anode.

16 Claims, 12 Drawing Sheets

ELECTROPLATING APPARATUS

BACKGROUND OF THE INVENTION

1. Field of the Invention

The present invention relates to an electroplating apparatus and more specifically to a structure of an electroplating apparatus for forming a metal film on a substrate.

2. Description of the Background Art

The principle of electroplating lies in that a voltage is applied to a cathode and an anode to deposit a metal from an electrolyte on the cathode side. In the reaction on the cathode side, electrons are supplied from the electrode to metal ions in the electrolyte, whereby the metal is deposited. The reaction on the anode side can be roughly classified as one of two kinds, according to the anode material.

If the metal to be deposited on the substrate is used as the anode material, the metal of the anode releases electrons to cause reaction in which the ions are eluted into the electrolyte. Such an anode is referred to as a soluble anode. On the other hand, if a metal nobler than the metal to be deposited on the substrate is used as the anode material, hydroxide ions (OH—) in the electrolyte release electrons at the anode to cause a reaction in which water and oxygen are generated. Such an anode is referred to as an insoluble anode.

An electroplating method using a soluble anode has an advantage in that the amount of metal ions in the electrolyte can be maintained constant because the same amount of metal as the metal deposited on the substrate is supplied from the soluble anode to the electrolyte.

FIG. 16 is a cross section view illustrating a structure of a Cu electroplating apparatus using a soluble anode, which is shown in Proc. of 1993 VLSI Multilevel Interconnection Conference, pp. 470–477. Referring to FIG. 16, this Cu electroplating apparatus includes a plating tank 1, a soluble anode 2, an electrolyte 3, a conductive layer 5 deposited on a substrate 4, a substrate holder 6 for holding the substrate 4, a contact electrode 7, an electrolyte inlet 8 having an opening end 8*a*, and an electrolyte outlet 9. The electrolyte 3 is introduced from the electrolyte inlet tube 8 into the plating tank 1, and is discharged from the electrolyte outlet 9 by overflowing. The soluble anode 2 is disposed in the electrolyte 3, and the substrate 4 fixed to the substrate holder 6 is disposed at an upper part opposite to the soluble anode 2. By thus disposing the substrate 4 at an upper part of the plating tank 1, the substrate 4 can be easily taken in and out of the electrolyte tank 1 without discharging the electrolyte.

An electric current must be passed in order to perform electroplating. For this purpose, the conductive layer 5, referred to as a seed layer, is formed on the substrate 4. In this structure, the electric current is supplied from the contact electrode 7 to the conductive layer 5, whereby the electroplating is performed. Further, in this Cu electroplating apparatus, a mechanism for rotating the substrate holder 6 can be adopted to produce a better film thickness distribution.

However, according to the method using this Cu electroplating apparatus, the volume of the soluble anode 2 decreases as the electroplating is performed, changing the distance between the soluble anode 2 and the cathode. This results in a change in the distribution of the thickness of the formed film or in the film quality.

Further, according to the plating method using this Cu electroplating apparatus, it is necessary to form a coating called a black film on the surface of the soluble anode 2 in order to carry out the elution of the soluble anode 2 smoothly. This black film includes an oxide of phosphorus, an oxide of copper, or the like added to the soluble anode 2. Since the adhesion strength of the black film is extremely weak, the black film disadvantageously causes particles in the electrolyte 3.

On the other hand, by an electroplating method using an insoluble anode, the anode is not eluted, so that the aforesaid problem is not raised. However, one of the problems involved in the electroplating method using an insoluble anode is generation of oxygen at the anode. If the substrate 4 is disposed above the anode in the same manner as in the electroplating apparatus using a soluble anode, the generated oxygen is accumulated on the surface of the substrate 4, thereby obstructing deposition of the metal on the substrate surface. In particular, if the substrate surface has irregularities, oxygen is accumulated in the recessed part to obstruct the deposition of the metal in the recessed part of the substrate surface, so that the recessed part is poorly filled.

Hitherto, in order to prevent such a problem, a construction has been adopted in which the substrate 4 is disposed below the anode in a conventional electroplating apparatus using an insoluble anode. FIG. 17 is a view illustrating a structure of a conventional Cu electroplating apparatus disclosed in Japanese Patent Laid -Open No. Hei. 06-280098. This Cu electroplating apparatus includes a plating tank 1, an electrolyte 3, a substrate 4, a conductive layer 5 on the substrate 4, a substrate holder 6, a contact electrode 7, an electrolyte inlet tube 8 having an opening end 8*a,* an electrolyte outlet 9, an insoluble anode 10, and a seal 11.

As shown in FIG. 17, in the conventional electroplating apparatus using an insoluble anode, a construction is adopted in which the substrate 4 is disposed below the anode. Therefore, the electrolyte 3 in the plating tank 1 must be discharged in exchanging the substrate 4. This results in a problem of long period of time for performing a plating process on the substrate 4.

Further, a small amount of the electrolyte 3 remains in the plating tank 1, making it difficult to control the amount of the electrolyte. Also, the residual electrolyte 3 adheres to the seal 11, and the electrolyte 3 adheres onto the surface of the conductive layer 5 on which the metal film is to be formed next, corroding the conductive layer 5. Furthermore, corrosion of the conductive layer 5 causes poor contact between the contact electrode 7 and the conductive layer 5. Also, the residual electrolyte 3 drips down on the outside of the plating tank 1, corroding wiring and other parts of the electroplating apparatus.

Further, since the substrate holder 6 cannot be rotated due to structural reasons, there will be a problem of poor film thickness distribution.

SUMMARY OF THE INVENTION

The object of the present invention is to provide an electroplating apparatus having a structure in which the cathode is disposed above the anode in the electroplating apparatus using an insoluble anode.

The electroplating apparatus according to the present invention is an electroplating apparatus in which a plating tank is filled with an electrolyte and a voltage is applied between a cathode and an anode disposed in the plating tank to form a metal film on a substrate on a cathode side, the electroplating apparatus including: an anode made of an insoluble material that is not eluted into the electrolyte at the time of forming the metal film; a cathode disposed above the anode; and a means disposed between the anode and the cathode for preventing oxygen generated at the time of forming the metal film, from reaching the substrate.

Disposal of such a means can prevent oxygen generated at the anode from reaching the cathode. As a result of this, deposition of metal on the cathode surface can be prevented from being obstructed by accumulation of generated oxygen on the cathode surface. In particular, this effect is great if the cathode surface has irregularities. This can provide a good thickness distribution of the film formed on the cathode.

Further, in order to realize the present invention in a more preferable state, a mesh filter is disposed between the anode and the cathode. Furthermore, in order to remove oxygen with certainty, the filter is disposed to include the anode in a plan view.

Here, if oxygen is accumulated on the filter, the electric field distribution and the electrolyte flow are disturbed to cause non-uniform thickness distribution of the formed film and poor reproducibility of film forming. In order to avoid such a state, the following modes are adopted.

As a preferable mode of the invention, the filter has a shape which is sloped upwards as viewed from a central part to an outer peripheral part of the filter. By adopting this shape, the oxygen that has reached the filter can be smoothly guided upwards.

Further, as a preferable mode of the invention, the filter has one or more openings circumferentially disposed in a vicinity of an outer peripheral part. Adoption of this configuration makes it possible to allow oxygen to escape from the openings disposed in the outer peripheral part of the filter. As a result of this, oxygen escapes outward through the outside of the cathode, so that the oxygen can be allowed to escape without reaching the cathode.

Further, as a preferable mode of the invention, the electroplating apparatus further includes an electrolyte inlet tube in the plating tank for introducing the electrolyte; the electrolyte inlet tube penetrates through a central part of the anode; and an opening end of the electrolyte inlet tube is disposed on an upper surface side of the anode. Further, as a more preferable mode of the invention, a lower outlet for letting the electrolyte out is disposed on a side surface of the electrolyte inlet tube positioned below the anode. Adoption of this construction makes it possible to form a flow of the electrolyte oriented from the central part towards the outer peripheral part of the filter, whereby the oxygen that has reached the filter can be smoothly guided to the openings.

Further, as a preferable mode of the invention, an opening is disposed at a central part of the filter. Adoption of this construction makes it easier to control the flow of the electrolyte, whereby a more uniform film thickness distribution can be obtained.

Further, as a preferable mode of the invention, the opening end of the electrolyte inlet tube is disposed to be in communication with the opening disposed at the central part of the filter. Furthermore, as a more preferable mode, the electrolyte inlet tube is disposed to extend to the opening. Furthermore, as a more preferable mode, an upper outlet for letting the electrolyte out is disposed on a side surface of the electrolyte inlet tube positioned between the filter and the anode. Further, as a preferable mode of the invention, the filter includes a hanging part that allows communication between the opening of the filter and the opening end of the electrolyte inlet tube. By this construction, the filter can be used even if the mechanical strength of the filter is small. Also, by disposing an upper outlet or lower and upper outlets, it is possible to make a flow of the electrolyte along the side surface of the plating tank 1.

Further, as a preferable mode of the invention, an outer peripheral part of the filter is connected to a lower end of a cylindrical member disposed in an inside of the plating tank. By this construction, an oxygen outlet is formed between the plating tank and the cylindrical member, whereby the oxygen captured by the filter can be discharged to the outside with certainty through this oxygen outlet. Therefore, the captured oxygen can be prevented from returning to the cathode side again.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereafter, electroplating apparatus according to various embodiments of the present invention will be described referring to the attached drawings.

(First Embodiment)

Figure 1:
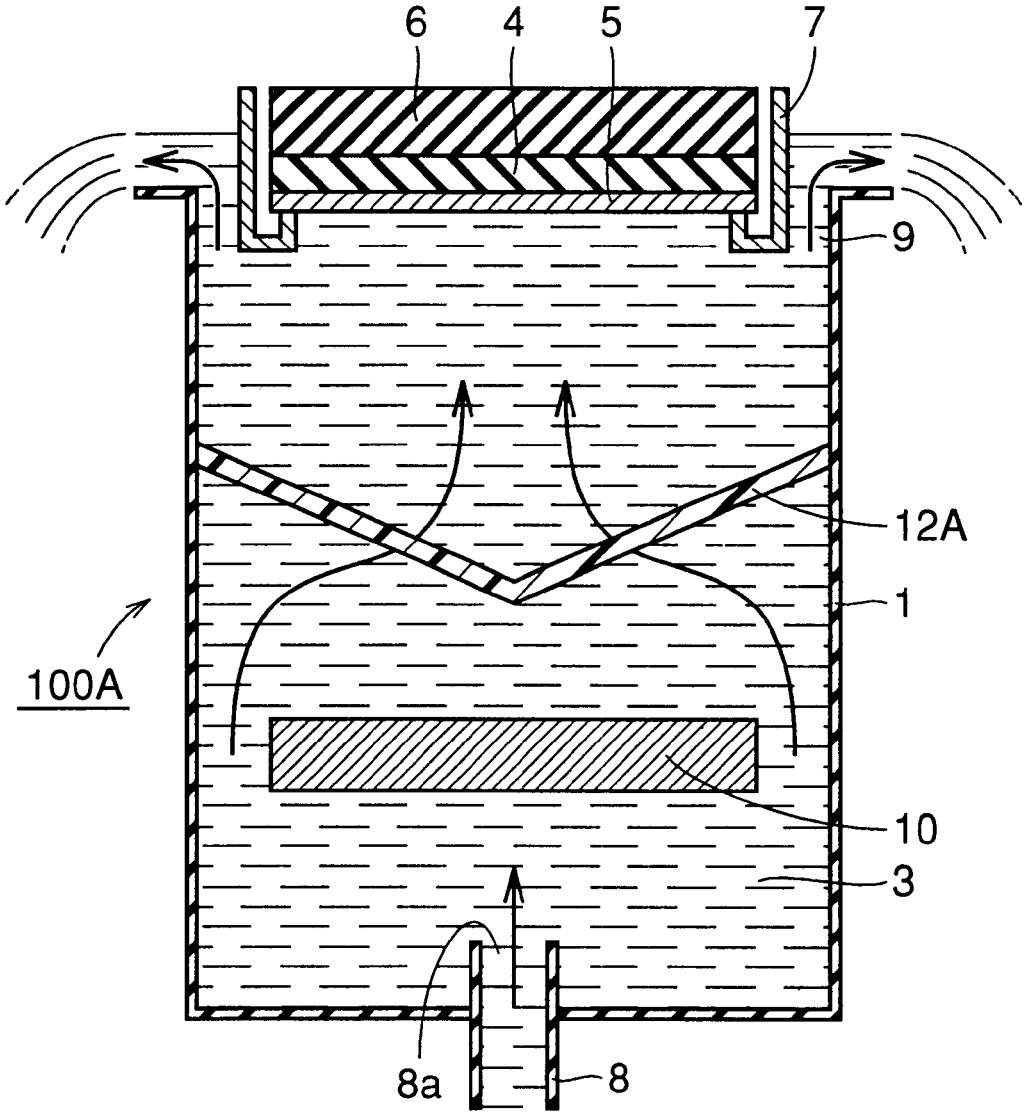
FIG. 1 is a cross section view illustrating an overall construction of an electroplating apparatus 100A according to a first embodiment of the present invention.
Figure 2:
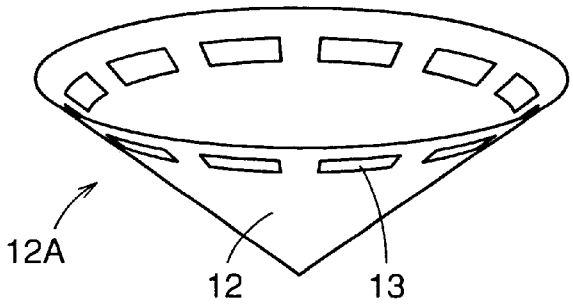
FIG. 2 is a perspective view of a filter 12A.

Referring to FIGS. 1 and 2, an electroplating apparatus 100A according to the first embodiment of the present invention will be described.

(Construction of Electroplating Apparatus 100A)

Referring to FIG. 1, the electroplating apparatus 100A includes a plating tank 1, an electrolyte 3, a substrate 4, a conductive layer 5 on the substrate 4, a substrate holder 6, a contact electrode 7, an electrolyte inlet tube 8 having an opening end 8*a*, an electrolyte outlet 9, an insoluble anode 10, and a filter 12A.

The electrolyte 3 is introduced from the electrolyte inlet tube 8 into the plating tank 1, and is discharged from the electrolyte outlet 9 by overflowing. The insoluble anode 10 is disposed in the electrolyte 3 at a lower part opposite to the substrate 4 fixed to the substrate holder 6.

When electroplating is carried out by supplying an electric current from the contact electrode 7 to the conductive layer 5, oxygen is generated at the insoluble anode 10. In order to remove this oxygen, the filter 12A is disposed between the insoluble anode 10 and the substrate 4 to cross the plating tank 1 above the insoluble anode 10. This filter 12A can prevent the oxygen from reaching the substrate 4. In order to effectively remove the oxygen, the filter 12A is disposed to include the insoluble anode 10 in a plan view.

(Shape of filter 12A)

Referring to FIG. 2, the shape of the filter 12A will be described. The filter 12A has a filter body 12, and a plurality of openings 13 are circumferentially disposed in an outer peripheral region of the filter body 12. By disposing the openings 13, the oxygen captured by the filter body 12 can be removed to the outside through the openings 13. If the oxygen is not removed, the oxygen will be accumulated on the filter body 12, whereby the electric field distribution and the electrolyte flow will be disturbed to cause poor film thickness distribution. As a result, problems will be raised such as poor reproducibility of film forming.

In order to remove oxygen with certainty, the openings 13 are disposed outside of the insoluble anode 10. In order to prevent the removed oxygen from returning to the substrate 4 side, the openings 13 are disposed outside of the substrate 5. Further, the filter body 12 is disposed to have a shape sloped upwards (an inverted conical shape) as viewed from the central part to the outer peripheral part of the filter body 12. The oxygen captured by the filter body 12 is guided smoothly to the openings 13 by this slope. The slope angle (angle of elevation) of the filter body 12 relative to the horizontal direction is about 20°. Further, the filter body 12 is made of PTFE, and has a mesh diameter (roughness) of about 1 μm.

(Comparison Experiment)

A comparison experiment was carried out on the Cu electroplating methods by using the electroplating apparatus 100A of this embodiment and the conventional electroplating apparatus that does not include the filter 12A. A silicon wafer having an oxidized surface was used as the substrate 4, and a groove having a width of 1 μm and a depth of 0.5 μm was formed in the oxide film by photolithography and dry etching. A Cu film was deposited thereon by sputtering to a thickness of 100 nm as the conductive layer 5, and then a Cu film was deposited to a thickness of 500 nm by electroplating.

The electrolyte at this time is composed of sulfuric acid, water, and copper sulfate, and contains a commercially available additive added thereto. The flow rate of the electrolyte and the electric current were set to be 5 L/min. and 5A, respectively. In the case without the filter 12A, a lot of defects were observed in which the groove was not filled with a Cu film. In contrast, in the case with the filter 12A, particular defects were not observed. Such a defect seems to have been generated because Cu could not be deposited due to accumulated oxygen in the groove. It is found out that generation of such defects can be prevented by disposing the filter 12A.

Here, in this embodiment, the filter body 12 was made of PTFE. However, one can make use of another polymer material such as Teflon resin or polypropylene. Further, one can make use of a ceramic material. As the ceramic material, Al2O3, SiC, and others can be used. Also, the filter body 12 was made of a mesh having a diameter (roughness) of about 1 μm. However, in order to remove oxygen, it is sufficient to use a mesh having a diameter (roughness) smaller than 250 μm. A film was formed by changing the mesh diameter (roughness). The results are shown in the following Table 1. When the filter body 12 was made of a mesh having a diameter (roughness) smaller than 250 μm, no defects were observed.

Here, if the filter body 12A is made of ceramics, the filter is porous, and its roughness is determined by its pore (hole) size. The mesh diameter (roughness) at this time is represented by the pore (hole) size.

TABLE 1

Filter diameter and film forming results

| Mesh diameter (roughness) | Filling of groove |
|---|---|
| 0.5 μm | Without defects |
| 1 μm | Without defects |
| 5 μm | Without defects |
| 10 μm | Without defects |
| 20 μm | Without defects |
| 100 μm | Without defects |
| 250 μm | With defects |

Further, as shown in the following Table 2, if the slope angle (angle of elevation) of the filter body 12 is not larger than 5°, it is found out that oxygen is accumulated on the filter body 12. The slope angle needed for smooth removal of oxygen may differ depending on the material of the filter body 12 and the flow rate of the electrolyte. However, the slope angle is preferably larger than 5°.

TABLE 2

Slope angle of filter and presence of accumulated oxygen

| Slope angle of filter | Accumulated oxygen |
|---|---|
| 30° | Absent |
| 20° | Absent |
| 10° | Absent |
| 5° | Present |
| 0° | Present |

(Function and Effect)

As described above, according to the electroplating apparatus 100A of this embodiment, since the substrate 4 is disposed above the insoluble anode 10, the substrate 4 can be easily taken in and out, and there is no need for discharging the electrolyte in the plating tank 1 after the electroplating is finished. Further, since a mechanism (not illustrated) for rotating the substrate holder 6 can be adopted, the film thickness distribution can be made better. Since the contact electrode 7 can be easily washed, the electrolyte adhering to the contact electrode 7 can be easily removed after the electroplating is finished, thereby preventing corrosion of the conductive layer on the next substrate.

Further, if the electroplating is carried out, oxygen is generated on the insoluble anode 10. However, since the filter 12A is disposed for removal of the oxygen, the oxygen can be prevented from reaching the substrate 4.

Also, since the openings 13 are disposed in the filter 12A and an upward slope is disposed towards the outside, the oxygen captured by the filter 12A can be smoothly discharged, thereby avoiding disturbance of the electric field distribution and the flow of the electrolyte and making a better thickness distribution of the film formed on the substrate 4.

(Second Embodiment)

Figure 3:
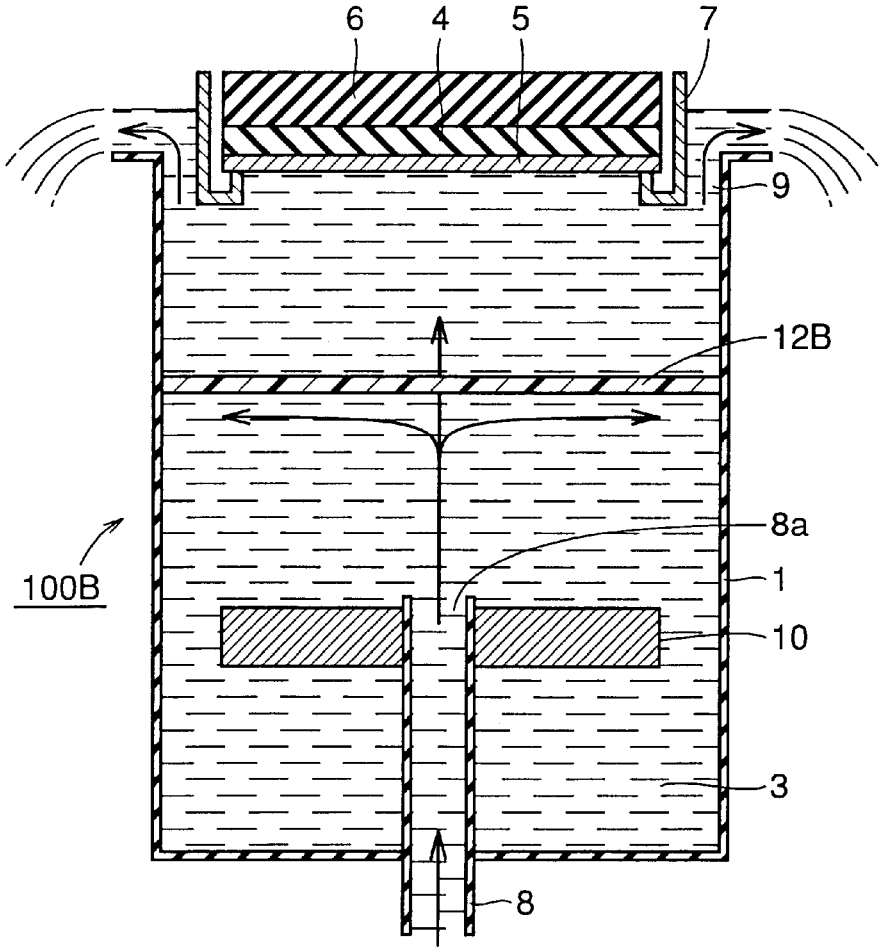
FIG. 3 is a cross section view illustrating an overall construction of an electroplating apparatus 100B according to a second embodiment of the present invention.
Figure 4:
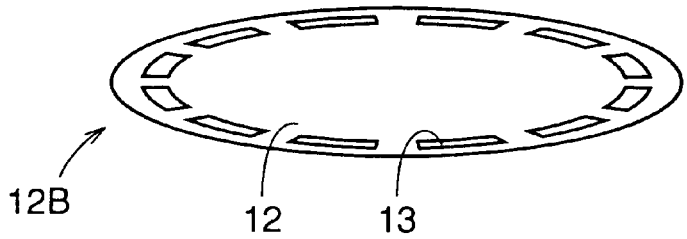
FIG. 4 is a perspective view of a filter 12B.

Referring to FIGS. 3 and 4, an electroplating apparatus 100B according to the second embodiment will be described.

(Construction)

In the construction of the electroplating apparatus 100A of the first embodiment, the filter 12A has a slope angle. However, a flat filter 12B may be used such as shown in FIGS. 3 and 4. Here, like or corresponding parts in the electroplating apparatus 100B of the second embodiment are denoted with the same reference numerals as in the electroplating apparatus 100A of the first embodiment, and their detailed description is omitted.

First, referring to FIG. 3, the characteristic construction of the electroplating apparatus 100B of this embodiment lies in that a through-hole 10*a* is disposed at the center of the insoluble anode 10, and the electrolyte inlet tube 8 is inserted so that the opening end 8*a* is positioned at the upper surface of the through-hole 10*a*, whereby the flow of the electrolyte 3 hits the central region of the filter 12B. Also, referring to FIG. 4, the filter 12B includes openings 13 which are circumferentially disposed in the outer peripheral part of the filter body 12 having a flat shape.

(Function and Effect)

As shown in FIG. 3, the flow of the electrolyte 3 that has reached the filter 12B is divided into a component passing through the filter 12B and a component extending from the center to the outer periphery of the filter 12B. The oxygen captured by the filter 12B is guided to the outer peripheral part of the filter 12B by the flow oriented from the center to the outer periphery of the filter 12B, and is discharged through the openings 13 disposed in the outer peripheral part of the filter 12B. By thus using the flow of the electrolyte 3, the captured oxygen can be effectively discharged even if a flat filter 12B is used.

A Cu electroplating was carried out with the electroplating apparatus of this embodiment using a substrate prepared in the same manner as the substrate 4 described in the first embodiment. A Cu film was deposited to a thickness of 500 nm, but no particular defects were observed.

Further, use of the flat filter 12B has a merit in that the filter 12B can be easily prepared, and its cost can be reduced. Also, the filter 12B has a function of adsorbing an additive. By using a flat shape in which the area of the filter 12B is reduced to the minimum, such a problem can be reduced to the minimum. Also, as compared with the structure of the first embodiment, this embodiment has merits in that the flow of the electrolyte is simple, and the film thickness distribution is good. In the first embodiment, the distribution of the thickness in the surface of the Cu film deposited to a thickness of 500 nm on an 8-inch wafer had a [standard deviation/average value] of 10%, whereas in this embodiment the [standard deviation/average value] was 6%, thereby showing an improvement. Here, the thickness of Cu film was measured by fluorescent X-ray. Here, the [standard deviation/average value] of 6% means that, when the film thickness is measured at plural points (49 points in this embodiment) in the wafer surface by fluorescent X-ray, the standard deviation/average value of the film thickness is 6%.

(Third Embodiment)

Figure 5:
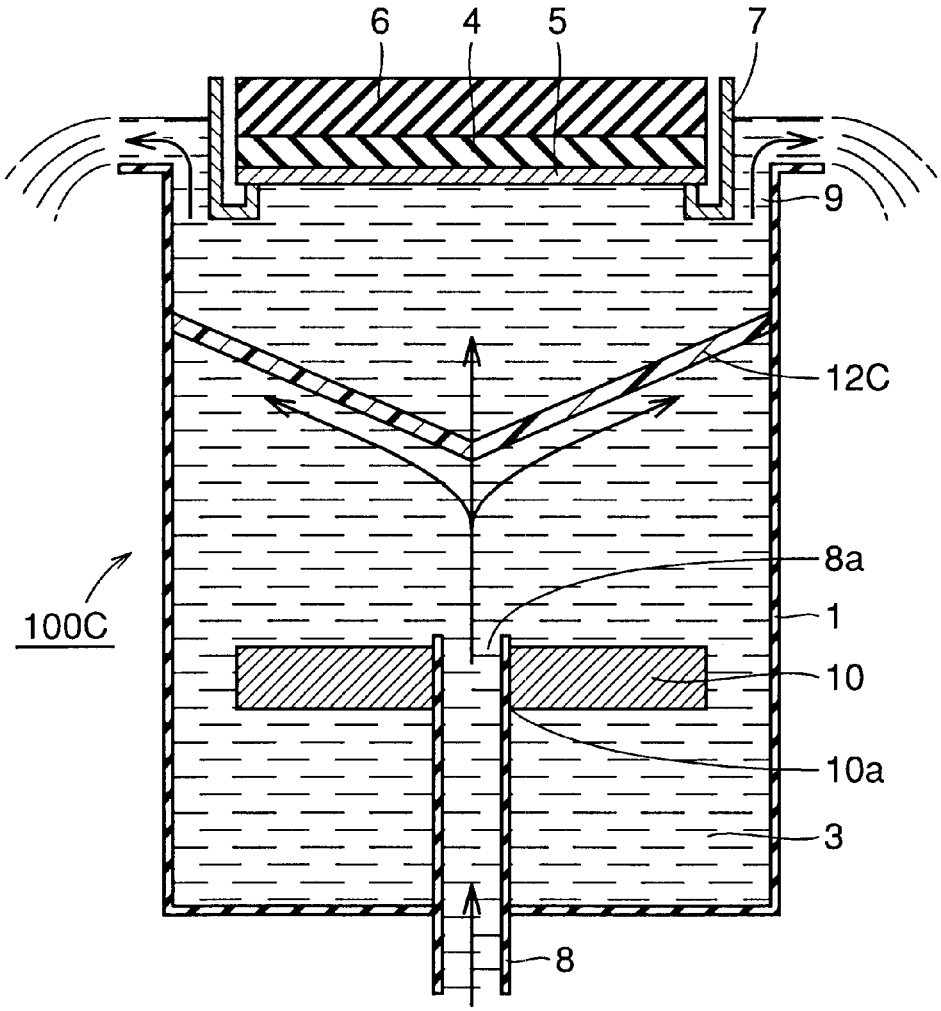
FIG. 5 is a cross section view illustrating an overall construction of an electroplating apparatus 100C according to a third embodiment of the present invention.

Referring to FIG. 5, an electroplating apparatus 100C according to the third embodiment will be described. Here, like or corresponding parts in the electroplating apparatus 100C of the third embodiment are denoted with the same reference numerals as in the electroplating apparatus 100A and 100B of the first and second embodiments, and their detailed description is omitted.

(Construction)

The electroplating apparatus 100C of this embodiment shown in FIG. 5 as a construction obtained by combination of the electroplating apparatus 100A of the first embodiment and the electroplating apparatus 100B of the second embodiment, and has a construction with the filter 12C having an inverted conical shape and a construction of forming a flow of the electrolyte oriented from the central part to the outer peripheral part of the filter 12C.

A Cu electroplating was carried out with the electroplating apparatus 100C of this embodiment using a substrate prepared in the same manner as the substrate 4 described in the first embodiment. A Cu film was deposited to a thickness of 500 nm, but no particular defects were observed on the substrate.

Further, as shown in the following Table 3, accumulation of oxygen occurred on the filter when the flow rate of the electrolyte was 5 L/min. in the second embodiment, whereas the accumulation of oxygen was not generated in this embodiment even if the flow rate of the electrolyte was 1 L/min. Thus, in this Example, oxygen can be removed more efficiently, thereby providing a merit of high degree of freedom in setting the flow rate of the electrolyte.

TABLE 3

Flow rate of electrolyte and presence of accumulated oxygen

| | Accumulated oxygen | |
|---|---|---|
| Flow rate of electrolyte | Second Embodiment | Third Embodiment |
| 1 L/min. | Present | Absent |
| 5 L/min. | Present | Absent |
| 10 L/min. | Absent | Absent |

Also, in this embodiment, the distribution of the thickness in the surface of the Cu film deposited to a thickness of 500 nm on an 8-inch wafer had a [standard deviation/average value] of 6%, thereby showing an improvement in the same manner as in the second embodiment.

As described above, according to the electroplating apparatus 100C of this embodiment, the oxygen captured by the filter can be more efficiently removed, as compared with the electroplating apparatus of the first and second embodiments, thereby effectively avoiding disturbance of the electric field distribution and the flow of the electrolyte and providing a still better thickness distribution of the film formed on the substrate.

(Fourth Embodiment)

Figure 6:
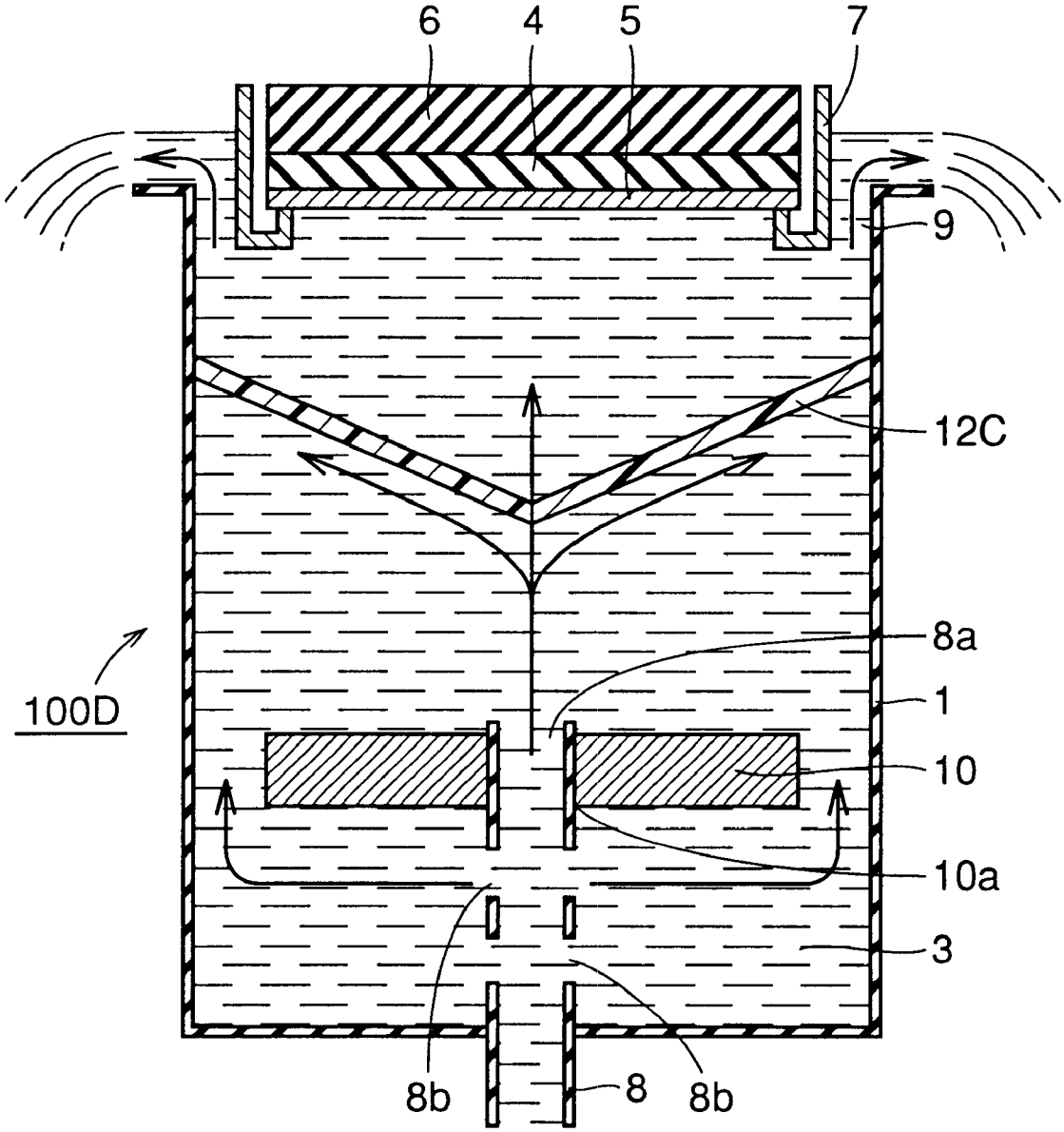
FIG. 6 is a cross section view illustrating an overall construction of an electroplating apparatus 100D according to a fourth embodiment of the present invention.

Referring to FIG. 6, an electroplating apparatus 100D according to the fourth embodiment will be described. Here, like or corresponding parts in the electroplating apparatus 100D of the fourth embodiment are denoted with the same reference numerals as in the electroplating apparatus 100A to 100C of the first to third embodiments, and their detailed description is omitted.

(Construction)

A characteristic construction of the electroplating apparatus 100D of this embodiment shown in FIG. 6 lies in that, as compared with the construction of the electroplating apparatus 100C of the third embodiment, a lower outlet 8*b* is disposed at a part of the electrolyte inlet tube 8 in the vicinity of the rear surface of the insoluble anode 10. The electrolyte 3 flowing from the lower outlet 8*b* forms a flow along the side surface of the plating tank 1.

(Function and Effect)

By forming such a flow of the electrolyte 3, the oxygen discharged from the openings 13 of the filter 12C can be prevented from returning to the substrate side again. Also, it is possible to prevent the electrolyte 3 from staying on the rear side of the insoluble anode 10 which causes uncontrollable state of the composition of the staying electrolyte 3.

A Cu electroplating was carried out with the electroplating apparatus 100D of this embodiment using a substrate prepared in the same manner as the substrate 4 described in the first embodiment. A Cu film was deposited to a thickness of 500 nm using a substrate prepared in the same manner as the substrate described in the first embodiment, but no particular defects were observed on the substrate. Further, the accumulation of oxygen was not generated even if the flow rate of the electrolyte was 1 L/min.

(Fifth Embodiment)

Figure 7:
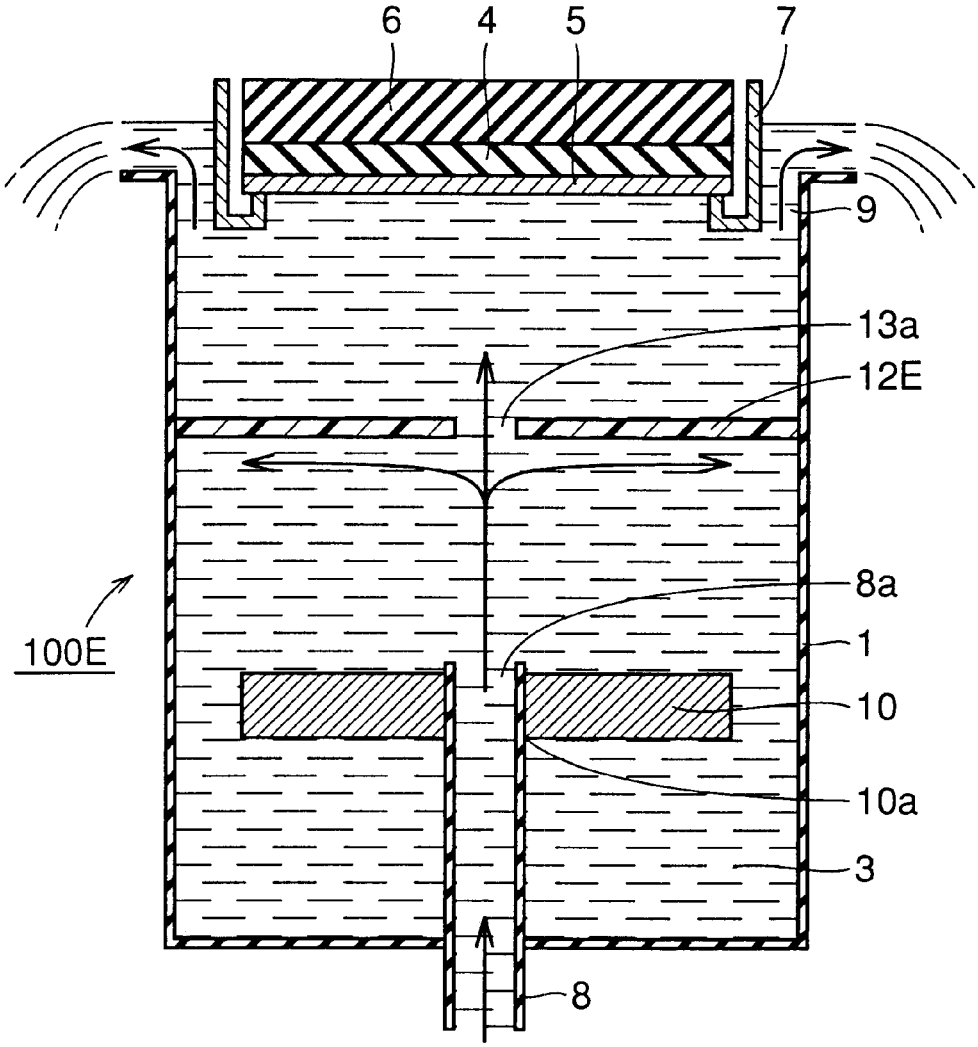
FIG. 7 is a cross section view illustrating an overall construction of an electroplating apparatus 100E according to a fifth embodiment of the present invention.
Figure 8:
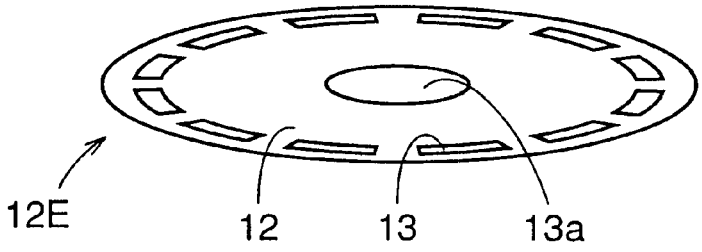
FIG. 8 is a perspective view of a filter 12E.

Referring to FIGS. 7 and 8, an electroplating apparatus 100E according to the fifth embodiment will be described. Here, like or corresponding parts in the electroplating apparatus 100E of the fifth embodiment are denoted with the same reference numerals as in the electroplating apparatus 100A to 100D of the first to fourth embodiments, and their detailed description is omitted.

(Construction)

When the electroplating apparatus 100E of this embodiment is compared with the electroplating apparatus 100B of the second embodiment, an opening 13*a* is disposed at the central part of the filter 12E.

(Function and Effect)

Referring to FIG. 8, by disposing the opening 13*a* at the central part of the filter 12E, a part of the flow of the electrolyte 3 introduced from the electrolyte inlet tube 8 can reach the substrate 4 without being hindered by the filter 12E. Thus, by reducing the effect of the filter 12E on the flow of the electrolyte 3 from the electrolyte inlet tube 8, the flow of the electrolyte 3 can be controlled more to obtain a more uniform film thickness distribution.

Further, since the pressure difference received by the filter 12E can be reduced, a finer filter can be used. A Cu electroplating was carried out with the electroplating apparatus 100E of this embodiment using a substrate prepared in the same manner as the substrate 4 described in the first embodiment. A Cu film was deposited to a thickness of 500 nm, but no particular defects were observed on the substrate. Also, the distribution of the thickness in the surface of the Cu film deposited to a thickness of 500 nm on an 8-inch wafer had a [standard deviation/average value] of 3%, thereby showing a good value.

Figure 9:
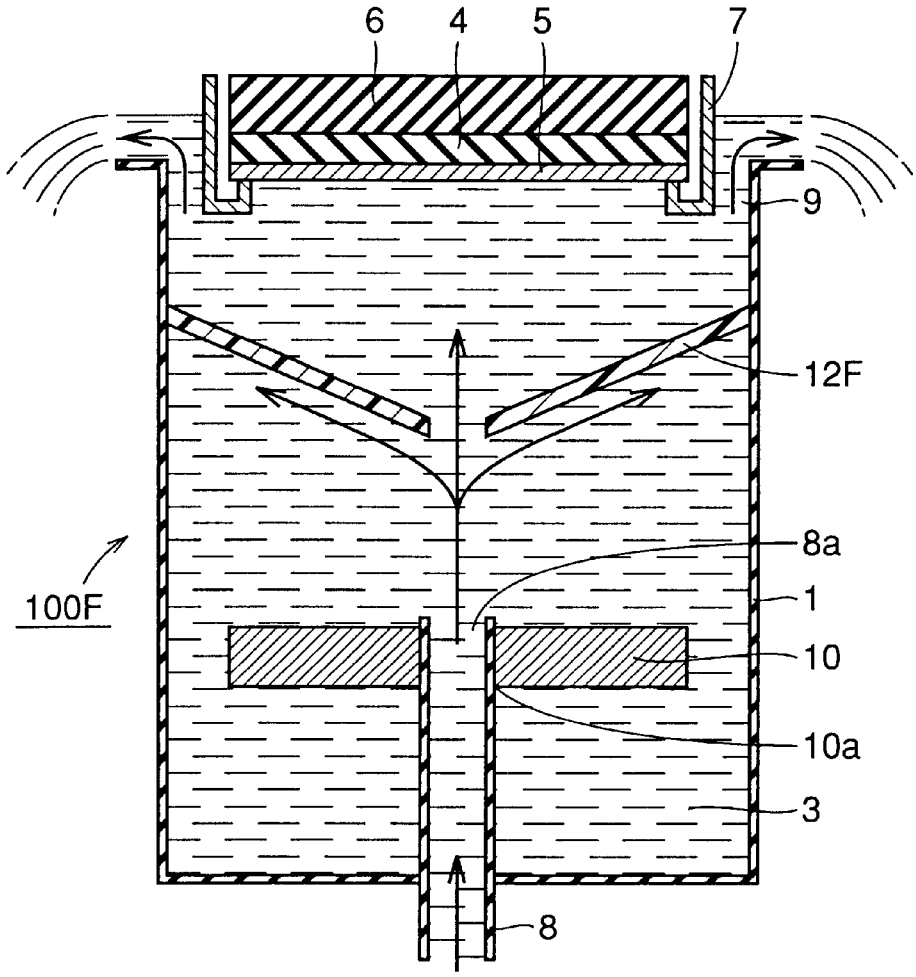
FIG. 9 is a cross section view illustrating an overall construction of an electroplating apparatus 100F according to another mode of the fifth embodiment of the present invention.
Figure 10:
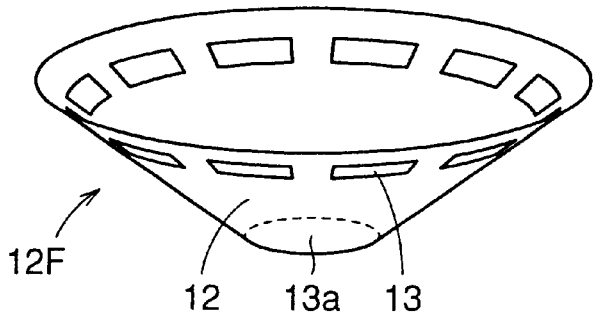
FIG. 10 is a perspective view of a filter 12F.

In the electroplating apparatus 100E shown in FIG. 7, a flat plane-like filter 12E is used; however, the same effect may be obtained even in the case of an electroplating apparatus 100F using a filter 12F having a slope as shown in FIGS. 9 and 10.

(Sixth Embodiment)

Figure 11:
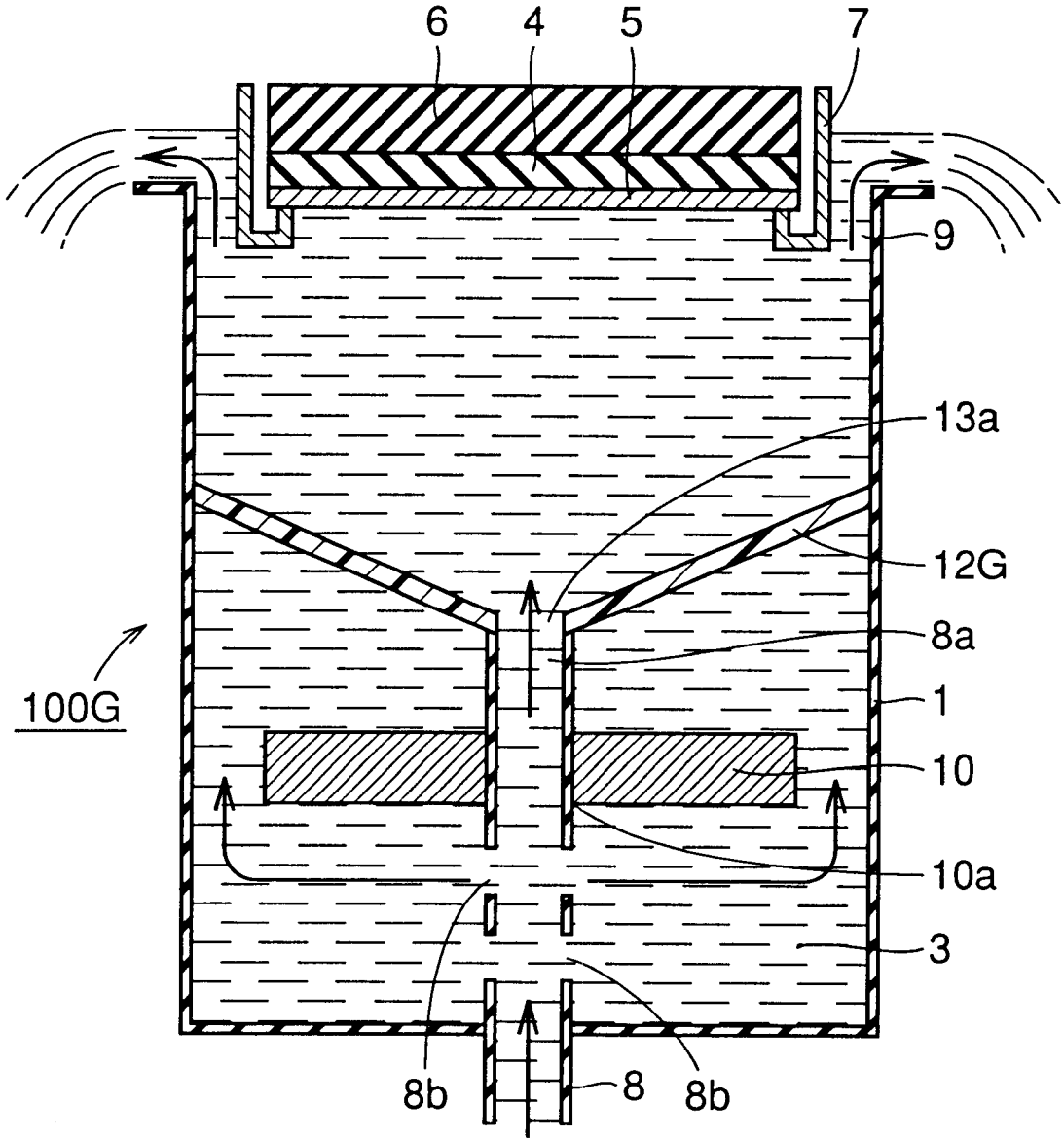
FIG. 11 is a cross section view illustrating an overall construction of an electroplating apparatus 100G according to a sixth embodiment of the present invention.

Referring to FIG. 11, an electroplating apparatus 100G according to the sixth embodiment will be described. Here, like or corresponding parts in the electroplating apparatus 100G of the sixth embodiment are denoted with the same reference numerals as in the electroplating apparatus 100A to 100F of the first to fifth embodiments, and their detailed description is omitted.

(Construction)

A characteristic construction of the electroplating apparatus 100G of this embodiment shown in FIG. 11 lies in that an opening 13*a* is disposed at the central part of a filter 12G; the electrolyte inlet tube 8 is disposed to extend to the opening 13*a* so as to allow communication between the opening 13*a* and the opening end 8*a* of the electrolyte inlet tube 8; and the opening 13*a* is fixed to the opening end 8*a*. Further, the opening 13*a* disposed at the central part of the filter 12G is disposed, in a plan view, in the inside of the through-hole 10*a* disposed also in the insoluble anode 10. Here, the filter 12G includes openings 13 in the same manner as the filter in each of the aforesaid embodiments.

Further, in the same manner as the electroplating apparatus 100D of the fourth embodiment, a construction is adopted in which a lower outlet 8*b* is disposed at a part of the electrolyte inlet tube 8 in the vicinity of the rear surface of the insoluble anode 10, whereby the electrolyte 3 flowing out of the lower outlet 8*b* forms a flow along the side surface of the plating tank 1

(Function and Effect)

By adopting such a structure, the filter 12G can be held by the side surface of the plating tank 1 and the electrolyte inlet tube 8, so that the filter 12G can be used even if the mechanical strength of the filter 12G is small. Also, as compared with the construction of the electroplating apparatus 100F shown in FIG. 9, it is possible to eliminate the possibility of oxygen passing through the opening 13*a* of the filter 12G.

Further, by forming such a flow of the electrolyte 3, the oxygen discharged from the openings 13 of the filter 12G can be prevented from returning to the substrate side again. Also, it is possible to prevent the electrolyte 3 from staying on the rear side of the insoluble anode 10 which causes uncontrollable state of the composition of the staying electrolyte 3.

A Cu electroplating was carried out with the electroplating apparatus 100G of this embodiment using a substrate prepared in the same manner as the substrate described in the first embodiment. A Cu film was deposited to a thickness of 500 nm using a substrate prepared in the same manner as the substrate described in the first embodiment, but no particular defects were observed on the substrate. Further, the accumulation of oxygen was not generated even if the flow rate of the electrolyte was 1 L/min.

A Cu electroplating was carried out with the electroplating apparatus 100G of this embodiment using a substrate prepared in the same manner as the substrate 4 described in the first embodiment. A Cu film was deposited to a thickness of 500 nm, but no particular defects were observed on the substrate. Also, the distribution of the thickness in the surface of the Cu film deposited to a thickness of 500 nm on an 8-inch wafer had a [standard deviation/average value] of 3%, thereby showing a good value.

Here, in this embodiment, the filter 12G is shown to have a slope; however, the same effect may be obtained even if the filter 12G does not have a slope.

(Seventh Embodiment)

Figure 12:
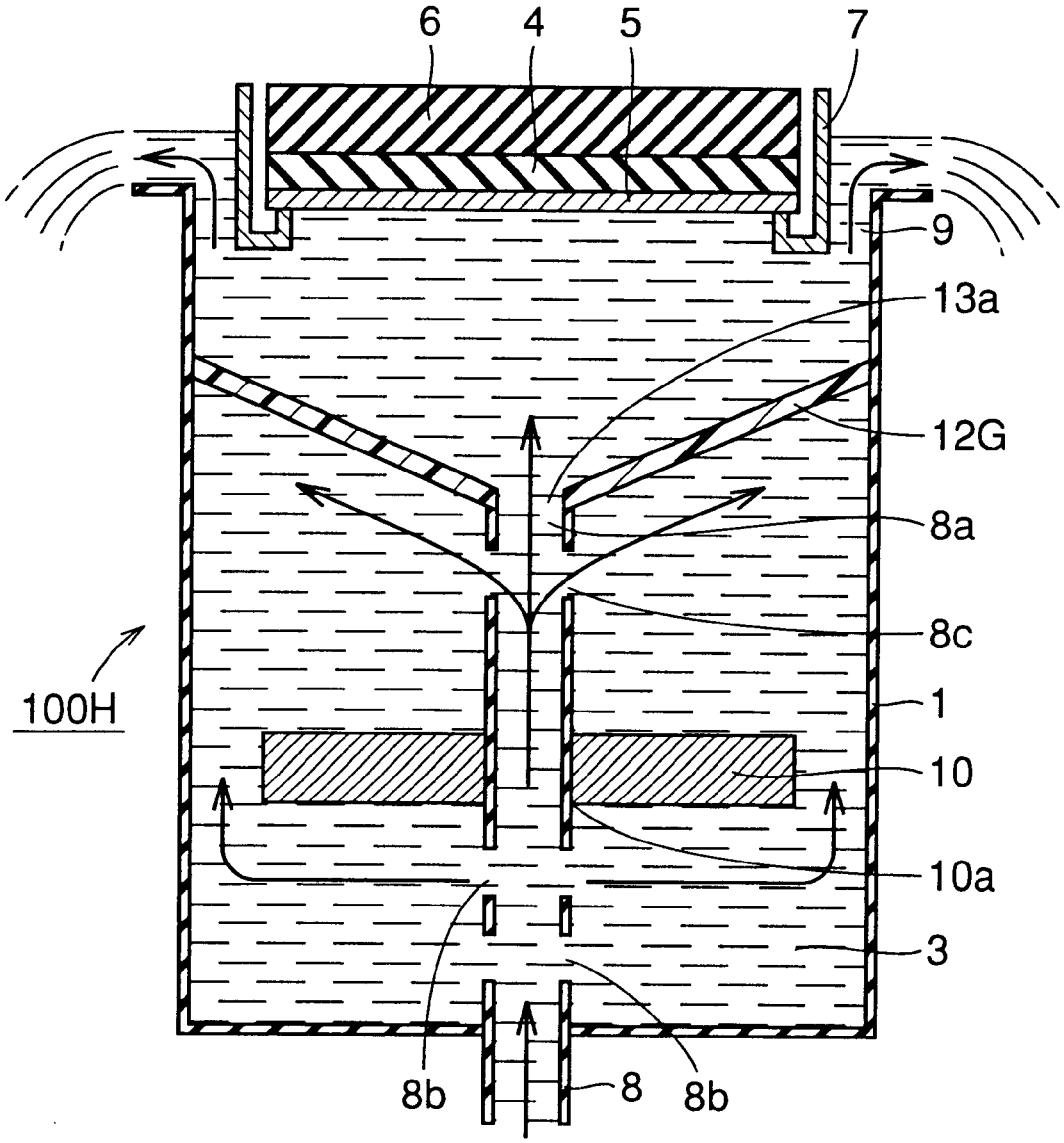
FIG. 12 is a cross section view illustrating an overall construction of an electroplating apparatus 100H according to a seventh embodiment of the present invention.

Referring to FIG. 12, an electroplating apparatus 100H according to the seventh embodiment will be described. Here, like or corresponding parts in the electroplating apparatus 100H of the seventh embodiment are denoted with the same reference numerals as in the electroplating apparatus 100A to 100G of the first to sixth embodiments, and their detailed description is omitted.

(Construction)

A characteristic construction of the electroplating apparatus 100H of this embodiment shown in FIG. 12 lies in that, as compared with the electroplating apparatus 100G of the sixth embodiment, an upper outlet 8*c* is further disposed at a part of the electrolyte inlet tube 8 which is protruding upwards from the insoluble anode 10.

(Function and Effect)

By thus disposing an upper outlet 8*c*, a flow of the electrolyte 3 oriented from the central part to the outer peripheral part of the filter 12G is formed, thereby producing an effect that the captured oxygen can be removed more efficiently. A Cu electroplating was carried out with the electroplating apparatus 100H of this embodiment using a substrate prepared in the same manner as the substrate 4 described in the first embodiment. A Cu film was deposited to a thickness of 500 nm, but no particular defects were observed on the substrate. Also, the distribution of the thickness in the surface of the Cu film deposited to a thickness of 500 nm on an 8-inch wafer had a [standard deviation/average value] of 3%, thereby showing a good value.

Here, in this embodiment, the filter 12G is shown to have a slope; however, the same effect may be obtained even if the filter 12G does not have a slope.

(Eighth Embodiment)

Figure 13:
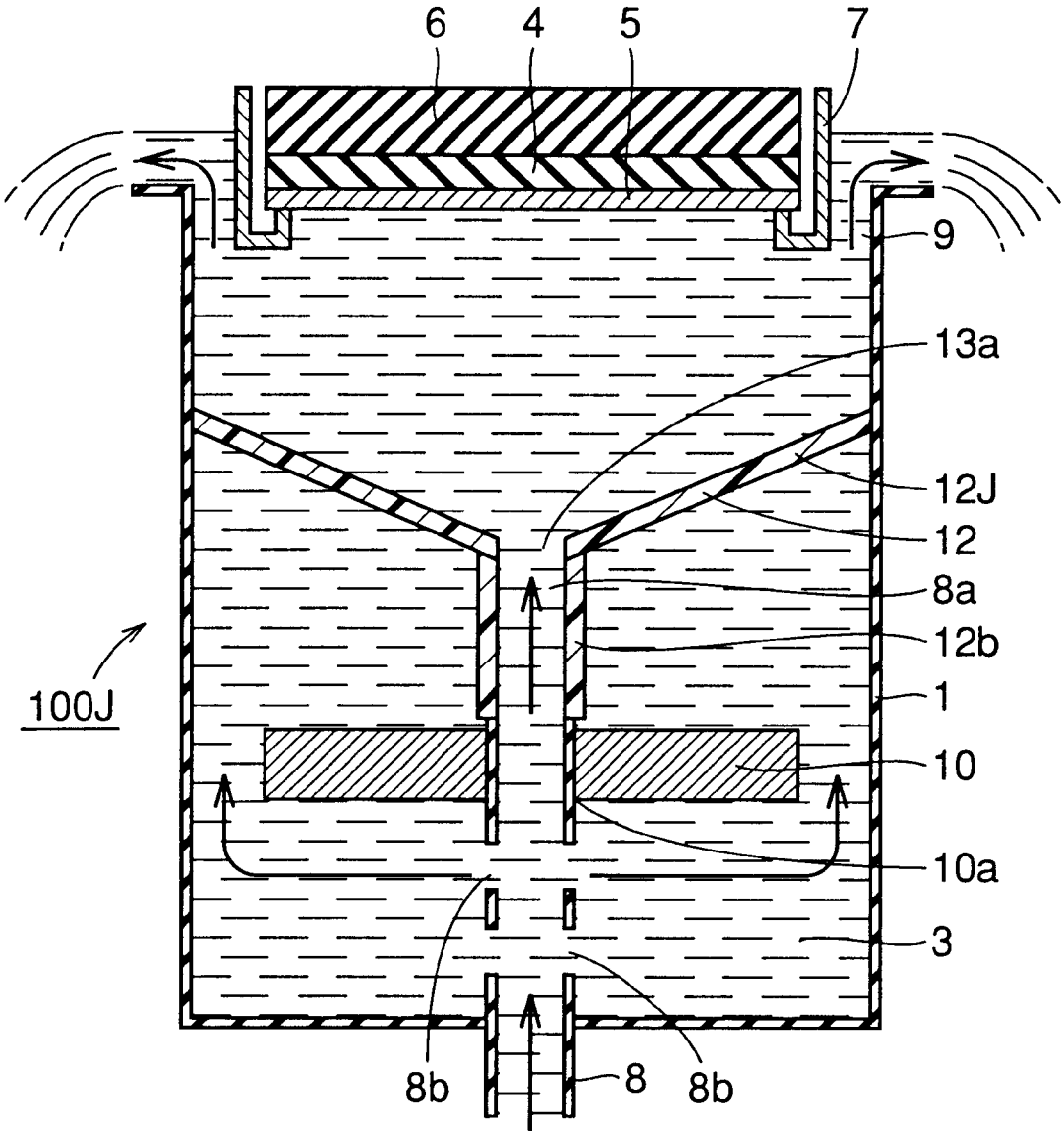
FIG. 13 is a cross section view illustrating an overall construction of an electroplating apparatus 100J according to an eighth embodiment of the present invention.

Referring to FIG. 13, an electroplating apparatus 100J according to the eighth embodiment will be described. Here, like or corresponding parts in the electroplating apparatus 100J of the eighth embodiment are denoted with the same reference numerals as in the electroplating apparatus 100A to 100H of the first to seventh embodiments, and their detailed description is omitted.

(Construction)

A characteristic construction of the electroplating apparatus 100J of this embodiment shown in FIG. 13 lies in that an opening 13*a* is disposed at the central part of the filter 12J, and a hanging part 12*b* that extends downwards from the opening 13*a* is fixed to the electrolyte inlet tube 8. The hanging part 12*b* allows communication between the opening 13*a* and the opening end 8*a* of the electrolyte inlet tube 8. Here, the filter 12J includes openings 13 in the same manner as the filter of each of the aforesaid embodiments.

Further, in the same manner as the electroplating apparatus 100D of the fourth embodiment, a construction is adopted in which a lower outlet 8*b* is disposed at a part of the electrolyte inlet tube 8 in the vicinity of the rear surface of the insoluble anode 10, whereby the electrolyte 3 flowing out of the lower outlet 8*b* forms a flow along the side surface of the plating tank 1

(Function and Effect)

By adopting such a structure, the filter 12J can be held by the side surface of the plating tank 1 and the electrolyte inlet tube 8, so that the filter 12J can be used even if the mechanical strength of the filter 12J is small. Further, since the electrolyte inlet tube 8 does not protrude above the insoluble anode 10, the electrolyte inlet tube 8 can be prevented from giving an influence on the electric field distribution. Also, as compared with the construction of the electroplating apparatus 100F shown in FIG. 9, it is possible to eliminate the possibility of oxygen passing through the opening 13*a* of the filter 12G.

Further, by forming such a flow of the electrolyte 3, the oxygen discharged from the openings 13 of the filter 12G can be prevented from returning to the substrate side again. Also, it is possible to prevent the electrolyte 3 from staying on the rear side of the insoluble anode 10 which causes uncontrollable state of the composition of the staying electrolyte 3.

A Cu electroplating was carried out with the electroplating apparatus 100J of this embodiment using a substrate prepared in the same manner as the substrate described in the first embodiment. A Cu film was deposited to a thickness of 500 nm, but no particular defects were observed on the substrate. Also, the distribution of the thickness in the surface of the Cu film deposited to a thickness of 500 nm on an 8-inch wafer had a [standard deviation/average value] of 2%, thereby showing a good value.

Here, in this embodiment, the filter 12J is shown to have a slope; however, the same effect may be obtained even if the filter 12J does not have a slope.

(Ninth Embodiment)

Figure 14:
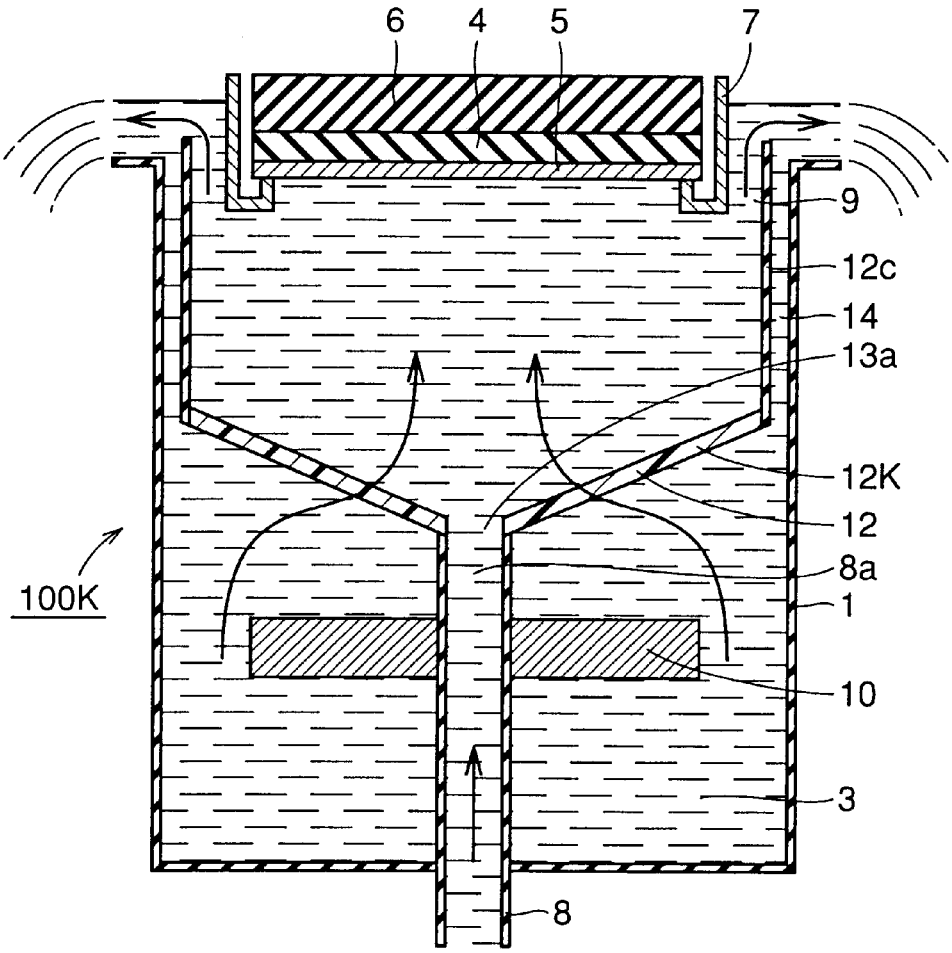
FIG. 14 is a cross section view illustrating an overall construction of an electroplating apparatus 100K according to a ninth embodiment of the present invention.
Figure 15:
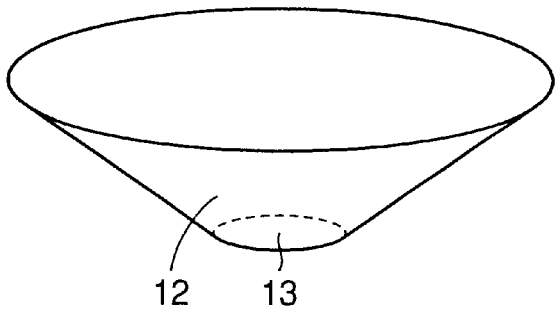
FIG. 15 is a perspective view of a filter body 12 of a filter 12K.
Figure 16:
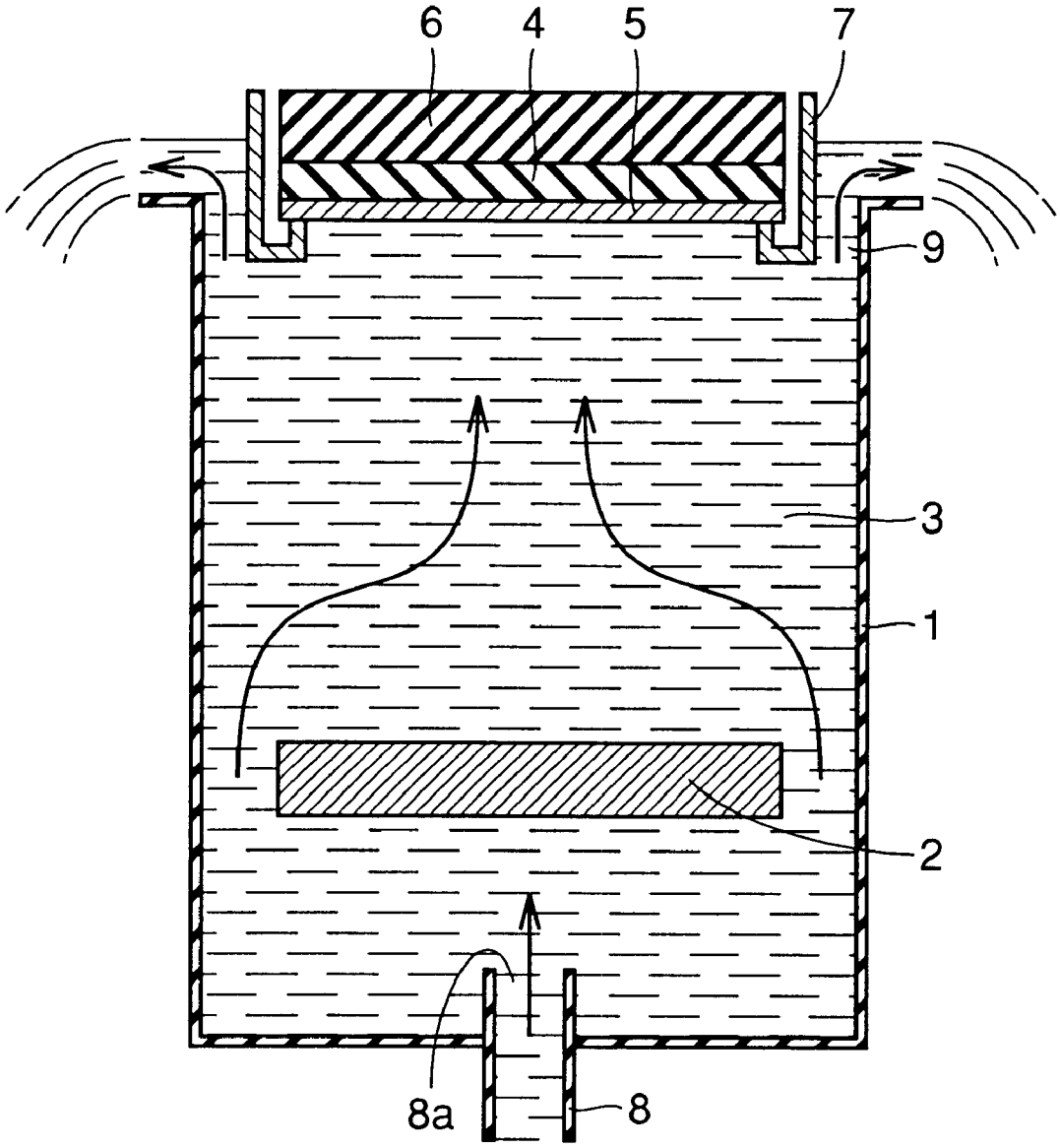
FIG. 16 PRIOR ART
FIG. 16 is a cross sectional view illustrating a structure of a prior art electroplating apparatus using a soluble anode.
Figure 17:
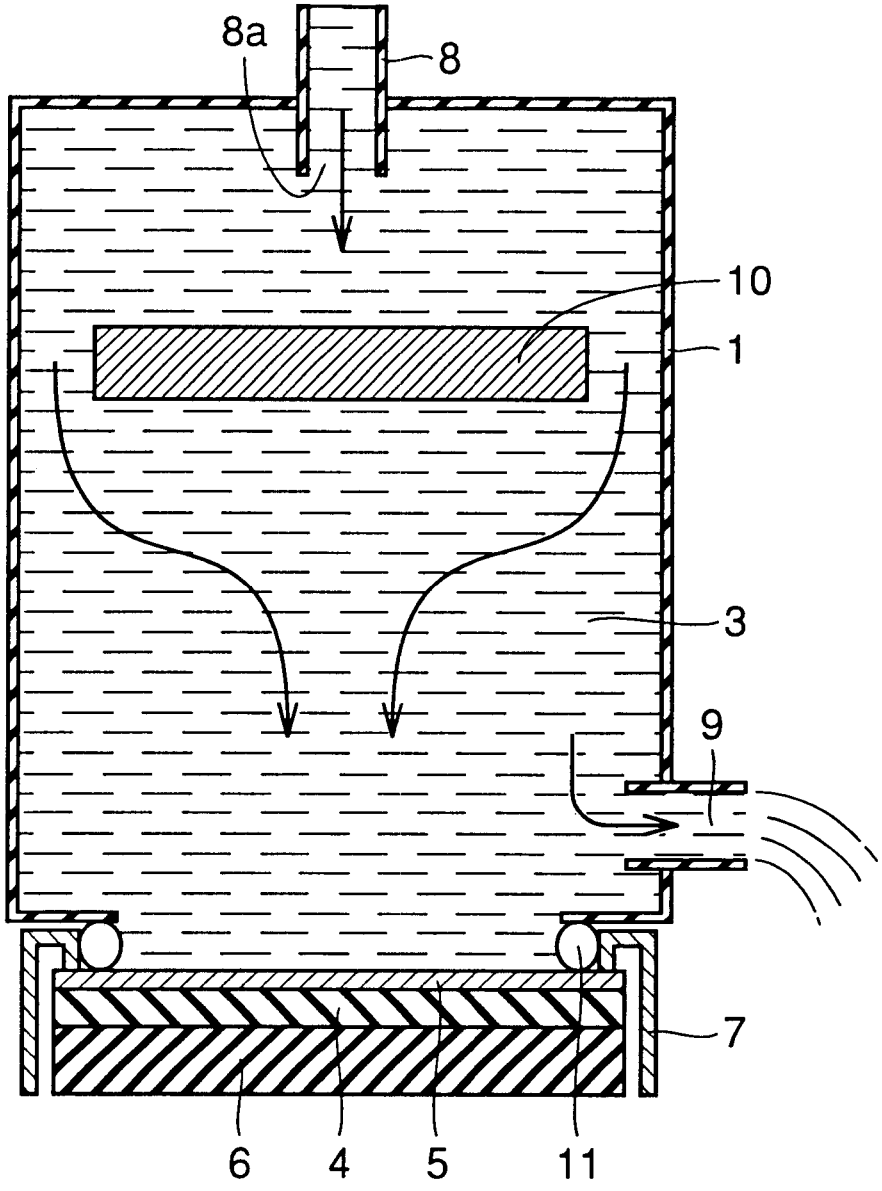
FIG. 17 PRIOR ART
FIG. 17 is a cross sectional view illustrating a structure of a prior art electroplating apparatus using an insoluble anode.

Referring to FIGS. 14 and 15, an electroplating apparatus 100K according to the ninth embodiment will be described. Here, like or corresponding parts in the electroplating apparatus 100K of the ninth embodiment are denoted with the same reference numerals as in the electroplating apparatus 100A to 100H and 100J of the first to eighth embodiments, and their detailed description is omitted.

(Construction)

A characteristic construction of the electroplating apparatus 100K of this embodiment shown in FIGS. 14 and 15 lies in that the filter body 12 of the filter 12K does not include openings 13 for allowing oxygen to escape, and instead, an upwardly extending cylindrical member 12*c* is disposed at the outer peripheral part of the filter body 12, whereby an oxygen outlet 14 is formed by the side wall 12*c* and the plating tank 1. Here, in this embodiment, an explanation has been given on the case in which the filter body 12 does not include openings 13; however, this does not exclude a structure in which the openings 13 are disposed.

(Function and Effect)

By thus forming the oxygen outlet 14, the oxygen captured by the filter 12K is discharged to the outside with certainty through the oxygen outlet 13, so that the captured oxygen does not return to the substrate side again.

A Cu electroplating was carried out with the electroplating apparatus 100K of this embodiment using a substrate prepared in the same manner as the substrate described in the first embodiment. A Cu film was deposited to a thickness of 500 nm, but no particular defects were observed on the substrate. Also, the distribution of the thickness in the surface of the Cu film deposited to a thickness of 500 nm on an 8-inch wafer had a [standard deviation/average value] of 3%, thereby showing a good value.

Here, the construction of the electroplating apparatus of each of the above-described embodiments is only an example, and it is not to be limited to the aforesaid modes, so that the characteristic structure of each electroplating apparatus can be suitably combined for use. For example, the oxygen outlet 14 constructed in the aforesaid ninth embodiment can be applied to the electroplating apparatus of each of the aforesaid embodiments.

Further, each of the aforesaid embodiments discloses a structure in which an electrolyte inlet tube 8 is disposed as a preferable mode; however, a structure in which an electrolyte inlet tube 8 is not disposed or a construction in which a flow is given to the electrolyte by another means can be adopted.

According to the electroplating apparatus based on the present invention, since a means for preventing the oxygen generated at the time of forming a metal film from reaching the substrate is disposed between the cathode and the anode, the oxygen generated at the anode can be prevented from reaching the cathode. As a result, it is possible to prevent accumulation of generated oxygen on the surface of the cathode and to prevent deposition of the metal on the cathode surface from being obstructed. This can make a better thickness distribution of the film formed on the cathode.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electroplating apparatus comprising:

a plating tank for holding an electrolyte;

an anode insoluble in an electrolyte filling said tank for forming a metal film on a substrate disposed in said tank;

a cathode disposed above said anode; and a filter disposed in said tank between said anode and said cathode permitting passage of the electrolyte, said filter preventing oxygen bubbles generated at said anode during forming of the metal film on the substrate from reaching the substrate and including at least one opening proximate an outer peripheral part of said filter for escape of the oxygen bubbles from said electroplating apparatus.

2. The electroplating apparatus according to claim 1, wherein said filter is a mesh filter.

3. The electroplating apparatus according to claim 1, wherein said filter, in a plan view, covers all of said anode.

4. The electroplating apparatus according to claim 3, wherein, in a plan view, the opening disposed proximate an outer peripheral part of said filter is not directly opposite the substrate.

5. The electroplating apparatus according to claim 1, wherein said filter is sloped upwards from a central part to the outer peripheral part of said filter.

6. The electroplating apparatus according to claim 1, further comprising an electrolyte inlet tube in said plating tank for introducing the electrolyte into said tank, wherein said electrolyte inlet tube penetrates through a central part of said anode, and an open end of said electrolyte inlet tube is disposed on an upper surface of said anode.

7. The electroplating apparatus according to claim 6, including an opening in a central part of said filter.

8. The electroplating apparatus according to claim 7, wherein said open end of said electrolyte inlet tube is in aligned with the opening in the central part of said filter.

9. The electroplating apparatus according to claim 8, wherein said electrolyte inlet tube extends to and contacts said filter at the opening in the central part of said filter.

10. The electroplating apparatus according to claim 9, including an upper outlet for flow of the electrolyte into and out of said tank, disposed in a side surface of said electrolyte inlet tube, within said tank, and positioned between said filter and said anode.

11. The electroplating apparatus according to claim 8, wherein said filter includes a tubular part extending between the opening in the central part of said filter to and contacting said open end of said electrolyte inlet tube.

12. The electroplating apparatus according to claim 6, including a lower outlet for flow of the electrolyte into and out of said tank, said lower outlet being disposed in a side surface of said electrolyte inlet tube, within said tank, and positioned below said anode.

13. The electroplating apparatus according to claim 1, including a cylindrical member disposed inside of said plating tank above said filter and connected to the outer peripheral part of said filter.

14. The electroplating apparatus according to claim 1, wherein said filter includes pores and the pores are smaller in size than 250 $\mu$m.

15. The electroplating apparatus according to claim 14, wherein the pores have a size are not exceeding 100 $\mu$m.

16. The electroplating apparatus according to claim 1, wherein, in a plan view, the opening disposed proximate an outer peripheral part of said filter is not directly opposite the substrate.

* * * * *